United States Patent [19]

Owen, Sr.

[11] Patent Number: 5,014,640

[45] Date of Patent: May 14, 1991

[54] STEP ASSEMBLY

[76] Inventor: H. Drew Owen, Sr., 16 Bridlewood, Edmond, Okla. 73034

[21] Appl. No.: 402,763

[22] Filed: Sep. 5, 1989

[51] Int. Cl.[5] ..... K63B 27/14

[52] U.S. Cl. ..... 114/362; 182/91

[58] Field of Search ..... 114/343, 362, 221 R; 182/90, 91

[56] References Cited

U.S. PATENT DOCUMENTS

| | | | |
|---|---|---|---|
| 3,033,309 | 5/1962 | Fugere | 182/90 |
| 3,825,097 | 7/1974 | Owen | 182/91 |
| 4,432,436 | 2/1984 | Suiter | 182/91 |
| 4,719,872 | 1/1988 | Ritten | 114/362 |

*Primary Examiner*—Jesûs D. Sotelo

*Attorney, Agent, or Firm*—Laney, Dougherty, Hessin & Beavers

[57] ABSTRACT

A step assembly mountable on a boat transom including a mounting bracket and a pivot block pivotally mounted on the mounting bracket for pivoting about a horizontal axis. An opening is formed through the pivot block, and an elongated step shaft extends through this opening. At one of its ends, the step shaft carries a horizontally extending step, and at its upper end it carries a stop cap. The step and the step shaft upon which it is carried can be pivoted from a downwardly extending, operative position, to an upwardly extending stored position.

9 Claims, 1 Drawing Sheet

STEP ASSEMBLY

FIELD OF THE INVENTION

This invention relates to a step assembly, and more particularly, to a step assembly which can be mounted on a boat transom or the like to enable a person to use a step forming a part of the assembly to step out of the water and into a boat upon which the assembly is mounted.

BRIEF DESCRIPTION OF THE PRESENT INVENTION

The present invention provides a step assembly which includes a single movable step which can be positioned adjacent the transom of a boat so as to permit a swimmer, or a person confronted with an aquatic emergency which has cast them into the water, to use the step to rise to a sufficient height relative to the boat to step over into the boat or sit upon the transom without excessive difficulty, and without the requirement for unusual strength.

Broadly described, the present invention is a step assembly which includes a base mounting bracket. The base mounting bracket is preferably U-shaped in cross-sectional configuration so as to include a pair of opposed, spaced, substantially parallel leg flanges and an apertured web plate interconnecting the leg flanges. A pivot block is pivotally supported between the leg flanges, and is spaced from the web plate to permit the pivot block to be pivoted through 180° without interference from the web plate.

The pivot block carries a central opening or aperture which is configured to permit it to slidably receive an elongated step shaft. A stop cap or plate is carried on the upper end of the step shaft and is selectively engageable with the base mounting bracket to prevent the step shaft from being rotated about its axis. The step shaft has a lower end which is connected to a step which extends substantially normal to the longitudinal axis of the elongated step shaft.

The stop cap carried at the upper end of the step shaft is generally polygonal configuration. The stop cap, when moved against the pivot block and into a position between the leg flanges of the base mounting bracket fits between these flanges so that sides of the stop cap will bear against the leg flanges to prevent the step shaft from rotating. This lowered position of the step shaft, in which the stop cap locks it against rotation, is attained at a time when a weight or force is brought to bear on the step to cause the step and the step shaft to move into a lowered position. When it is desired to rotate the step shaft so as to locate the step carried on the lower end thereof in a different orientation relative to the boat, this is accomplished by sliding the shaft upward so that it slids through the pivot block until the stop cap is elevated above the top of the base mounting bracket, and clear of the two leg flanges thereof. In this raised position the shaft may be rotated through 90°, 180°, 270° or 360°, and then secured in the selected position of rotation simply by lowering the step shaft and the stop cap carried at the upper end thereof until the stop cap is between the leg flanges of the base mounting bracket. At its lower end, the base bracket carries a notched or recessed guide plate through which the step shaft extends.

An important object of the present invention is to provide a step shaft and a step assembly which can be quickly mounted by a swimmer or other person in the water adjacent the stern of the boat, and used to allow that swimmer or person to safely climb upwardly into the boat without excessive physical exertion.

A further object of the invention is to provide a step assembly mountable on the stern of a boat and movable between an operative, downwardly extending position, in which it can be used to aid a person to enter the boat from the water, to a stored, transport position in which it extends up and over the transom of the boat in an out-of-the-way location.

GENERAL DESCRIPTION OF THE DRAWINGS

DETAILED DESCRIPTION OF A PREFERRED EMBODIMENT OF THE INVENTION

Figure 1:
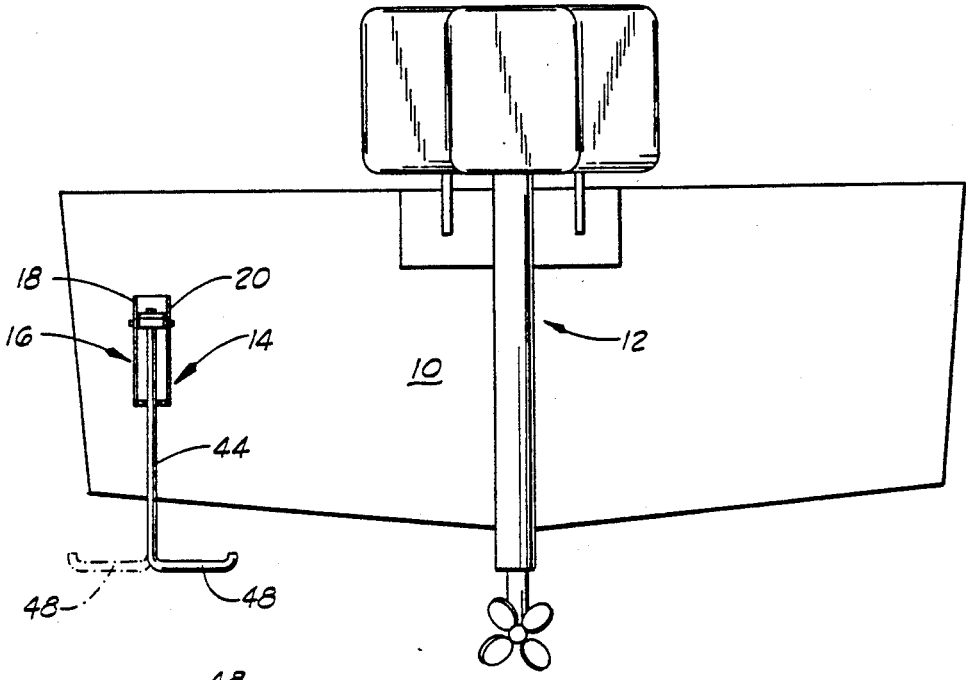
FIG. 1 is a rear elevation view of the stern of a boat to which the step assembly of the present invention has been mounted. An alternate position of the step assembly is depicted in dashed lines.

Referring to FIG. 1 of the drawings, the transom located at the stern of a boat is denominated by reference numeral 10. In the center of the transom 10, an outboard motor 12 is illustrated as mounted in conventional fashion. The step assembly of the present invention is mounted on the transom as illustrated in FIG. 1, and is denominated generally by reference numeral 14.

The step assembly 14 of the invention includes a base mounting bracket 16 which has an upper end and a lower end. The mounting bracket 16 functions to permit the step assembly 14 to be secured to the transom, and certain elements of the step assembly to be pivotally supported for pivoting about a horizontal axis.

Figure 3:
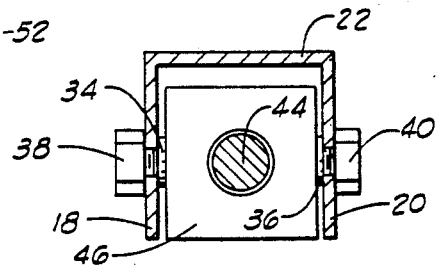
FIG. 3 is a sectional view taken along line 3—3 of FIG. 2.
Figure 4:
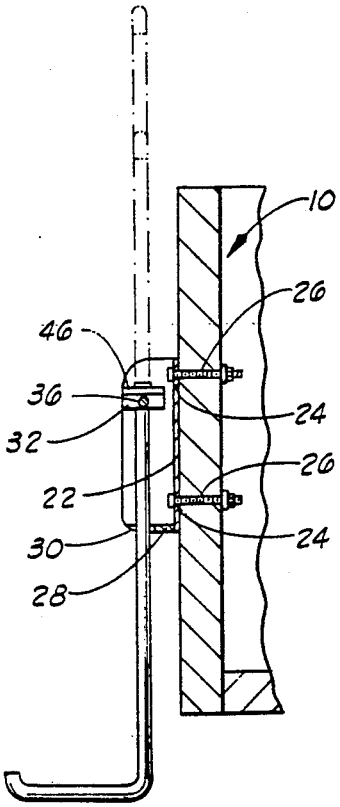
FIG. 4 is a side elevation view of the step assembly of the invention as it appears when viewed from the side, and at an angle of 90° from the view depicted in FIGS. 1 and 2.

The mounting bracket 16 is, in a preferred embodiment, of generally U-shaped cross-sectional configuration. It thus includes a pair of opposed, substantially parallel leg flanges 18 and 20 which project rearwardly and substantially normal to the plane of the transom (as shown in FIGS. 3 and 4). The opposed, substantially parallel leg flanges 18 and 20 are interconnected by a web plate 22. The web plate 22 defines apertures 24 which function to receive suitable fastening devices, such as bolts 26, which extend through the apertures and through the transom 10.

A slotted guide plate 28 (FIGS. 2 and 4) extends between the leg flanges 18 and 20 at the lower end of the web plate 22. The slotted guide plate 28 carries a relatively narrow slot 30 which guides an elongated step shaft extended through the slot in a manner hereinafter described.

Pivotally supported between the opposed, substantially parallel leg flanges 18 and 20 is a pivot block denominated generally by reference numeral 32 (FIG.

1). The pivot block 32 can conveniently be of rectangular parallelepiped configuration, as illustrated, or it can be other shapes. The pivot block 32 is pivotally supported by a pair of stub shafts 34 and 36 (FIG. 3) which extend from opposite sides thereof, and journal the pivot block 32 in the leg flanges 18 and 20 for pivoting about a substantially horizontally extending axis. For the purpose of mounting the pivot block, the stub shafts 34 and 36 may carry heads 38 and 40, respectively, positioned at the outer side of the respective parallel leg flanges 18 and 20. The pivot block 32 defines a central elongated opening or passageway 42 (see FIG. 2) therethrough which has its axis extending substantially perpendicular to the horizontal pivotal axis of the pivot block. The aperture or passageway 42 is, in the illustrated embodiment, of round cross-sectional configuration as shown in FIG. 3.

Figure 5:
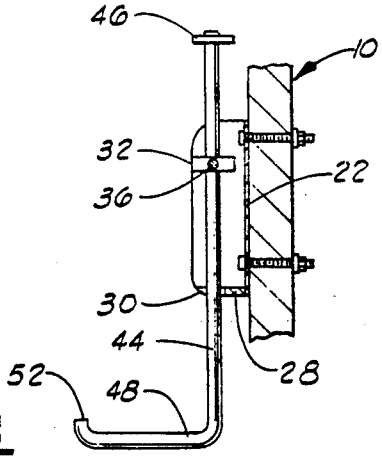
FIG. 5 is a side elevation view of the step assembly in a raised, step swiveling position.

An elongated step shaft, denominated generally by reference numeral 44, is movably mounted within the aperture 42 formed through the pivot block 32. The step shaft 44 is cylindrical and has an upper end and a lower end. The step shaft is rotatable within the pivot block 32 about its longitudinal axis through 360° at a time when the step shaft is slid upwardly to the position shown in FIG. 5.

At its upper end, the step shaft 44 in joined to a stop plate 46. The stop plate 46 is substantially rectangular in configuration, and extends substantially normal to the longitudinal axis of the step shaft 44. The purpose and function of the stop plate 46 will be hereinafter explained. At its lower end, the elongated step shaft 44 carries a step 48 which projects substantially normal to the longitudinal axis of the step shaft. A retaining toe 52 is formed at the free outer end of the step 48 and is turned in a reverse direction so that the step shaft 44, the step 48 and the retaining toe 52 form a U-shaped configuration.

In FIG. 4 of the drawings, the operative status of the step assembly of the invention is depicted in solid lines, and the inoperative stored, or transport, position is shown in dashed lines. It will be noted in referring to FIGS. 1 and 4 that the elongated step shaft 44 extends through the slot 30 formed in the slotted guide plate 28. This arrangement helps to guide the step shaft 44, and prevents it from canting or moving laterally when it is in the operative position shown in FIGS. 1 and 4. The slot 30 permits the shaft 44 to swing or pivot outwardly away from the transom of the boat, however, for the purpose of permitting it to be moved from the operative, downwardly extending position, to the inoperative, upwardly extending, stowed position as hereinafter explained.

The stop plate 46 is dimensioned so that, as shown in FIG. 3, in the locking position it cannot undergo rotation about the longitudinal axis of the step shaft 44 without the opposed parallel side of the stop plate being arrested by contact with the leg flanges 18 and 20 of the base mounting bracket 16. Thus, at a time when the step shaft 44 is pulled downwardly through the pivot block 32 until the stop plate 46 is positioned within the base mounting bracket 16, the shaft cannot undergo rotation because the stop plate is limited in its rotative movement by the leg flanges 18 and 20. At this time, one standing on the step 48 will not experience an undesirable swiveling or pivoting of the step shaft about its longitudinal axis, but instead, a stable step is provided which will stably support the weight of a person.

OPERATION

With the step assembly of the present invention mounted to the transom of a boat in the manner illustrated and hereinbefore described, a swimmer, water skier or even a fisherman who may, for some reason be out of the boat and in the water may easily enter the boat from a position adjacent the stern of the boat. To enter the boat the person in the water first grasps the top edge of the transom 10 at a location relatively near to the center of the transom. One foot is then placed on the step 48 and the person shifts the weight onto the step by pulling himself upwardly in the water, using the step and his grip on the transom.

As the person's weight is brought to bear on the step 48, the step shaft 44, and the stop plate 46 attached to the upper end thereof, are caused to move downwardly in an axial direction with the shaft sliding through the elongated opening or passageway 42 in the pivot block 32. Once the stop plate 46 passes into the channel defined between the leg flanges 18 and 20, and the web portion 22 of the base mounting bracket 16, the rotational movement of the shaft 44 about its axis is severely restricted and the step is stable to the person supported thereon. Actually, it is, as would be supposed, preferable to initially simply manually move the shaft 44 downwardly through the pivot block 32 until it is locked against rotation by the proper positioning of the stop plate 46 within the channel formed by the base mounting bracket 16.

After the person has brought himself to a standing position upon the step 48, it is then possible to easily turn the body 90° away from the boat to facilitate sitting on the top edge of the transom. From this sitting position, the feet can be swung into the boat. Alternatively, after standing up on the step 48, the body can be turned 90° toward the boat, and the knee of the other leg can be placed on the top of the transom.

It is important to note that the most suitable position of use of the step is where the step 48 projects rearwardly from the boat - that is, it extends at an angle of 90° with respect to the surface of the transom. In this position of the step, the side of the body of the person using the step is adjacent the transom, rather than facing the transom, as would be the case in using a conventional ladder. Being alongside the transom in this manner, the user can easily position the body above the step before rising. Therefore, the main operative muscles in the person standing on the step and about to enter the boat are in the leg, rather than in the upper body. This greatly improves the ease of raising the body weight to the level of the top of the transom.

When the boat is underway, or when, for some other reason, it is desired to have the step assembly in a position such that the step 48 does not extend beneath the keel of the boat to there constitute a potential obstruction, the step shaft 44 can be pivoted upwardly by reason of the pivotal mounting of the pivot block 32 in the mounting bracket 16. Pivotation of the shaft 44 upwardly will, of course, occur at a time when the stop plate 46 has been pulled downwardly to the position illustrated in FIG. 3. In this position, it is within the channel defined by the mounting bracket 16 and immediately adjacent the top of the pivot block 32.

Figure 2:
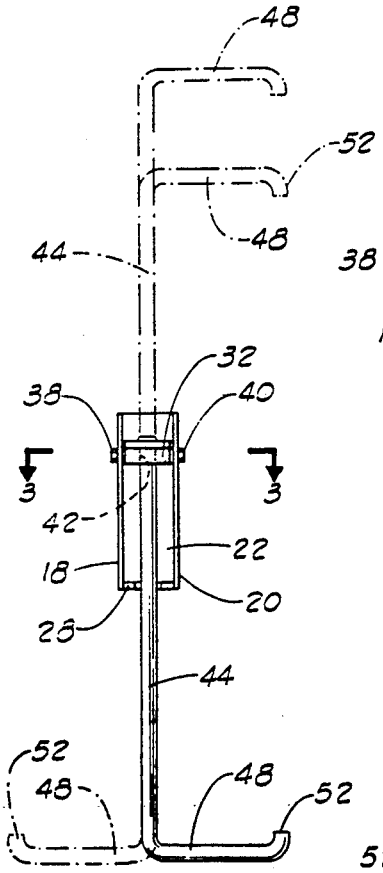
FIG. 2 is an elevation view of the step assembly of the present invention, and showing the profile of the step assembly as it appears in several positions, and showing how the step can be swung between a raised, stowed, transport position, and a lowered, operative position. Alternate positions are depicted in dashed lines.

At this time, by pulling outwardly and upwardly on the step shaft 44, it can be caused to pivot outwardly and upwardly to the position depicted in dashed lines in FIGS. 2 and 4 of the drawings. This movement is permitted by the slot 30 in the slotted guide plate 28. After the step shaft 44 has been pivoted upwardly as shown, the square sides of the stop cap 46 will remain positioned between the leg flanges 18 and 20 of the mounting bracket 16, thus preventing rotation of the shaft 44 and step 48. The shaft is then pushed downwardly until the stop cap 46 rests against the slotted guide plate 28 at the bottom of the mounting bracket 16.

Although a preferred embodiment has been herein described in order to illustrate the operating principles of the invention in sufficient detail and with sufficient clarity to permit one skilled in the art to practice the invention, it will be understood that various changes can be made in the described structure without departure from the basic principles of the invention, except as the same may be limited by the appended claims, or reasonable equivalents thereof.

What is claimed is:

1. A step assembly comprising:

a mounting base bracket;

an apertured pivot block pivotally mounted on said mounting base bracket;

an elongated step shaft extending slidably through the aperture in the pivot block and including a first end disposed on one side of the pivot block, and a second end disposed on the opposite side of the pivot block;

a step secured to the second end of said step shaft, and extending substantially normal to the longitudinal axis thereof; and a stop plate secured to the first end of said step shaft and movable, upon axial sliding movement of said step shaft, from a first, freely rotating position above said base bracket, to a second, locked, non-rotative position in contact with said base bracket.

2. A step assembly as defined in claim 1 wherein said mounting base bracket is generally U-shaped in configuration and includes:

a pair of substantially parallel leg flanges and an interconnecting web plate; and wherein said pivot block is pivotally mounted between said leg flanges and spaced from said web plate for pivoting about a pivotal axis extending normal to said leg flanges and parallel to said web plate.

3. A step assembly as defined in claim 2 wherein said base bracket further includes:

an upper end;

a lower end; and a slotted guide plate secured between said leg flanges at the lower end of said base bracket and receiving said elongated step shaft therein in a lowered, operative position of the step shaft.

4. A step assembly as defined in claim 2 wherein said stop plate is of generally rectangular configuration and includes a pair of opposed sides positioned to contact, and, by such contact, be prevented from moving, when said stop plate is positioned between said parallel leg flanges and over said pivot block.

5. A step assembly as defined in claim 1 wherein said step and said elongated step shaft are a single rod, with said step bent at an angle of 90° from the longitudinal axis of said elongated step shaft at said second end of said step shaft.

6. A step assembly adapted for securement to the transom of a boat to facilitate stepping from the water into the boat comprising:

a mounting base bracket adapted for securement to the boat transom;

an apertured pivot block pivotally supported on said mounting base bracket for pivoting about a substantially horizontally extending axis, said pivot block having an elongated aperture extending therethrough from one side of the block to the other, with the axis of said elongated aperture extending normal to the pivotal axis of said pivot block;

an elongated step shaft extending movably through said elongated aperture and having a first end and a second end;

a step connected to the second end of said step shaft and extending substantially normal to the longitudinal axis thereof; and locking means carried on said elongated step shaft and movable with said step shaft between a locked, non-rotative position in which said locking means acts to prevent rotation of the shaft, to a freely rotative position, in which said locking means is passive and permits said shaft to rotate.

7. A step assembly as defined in claim 6 wherein said locking means comprises an element projecting radially outwardly from said elongated step shaft and engageable with said base bracket when said step shaft is moved in the direction of said second end to thereby place said locking means in said locked, non-rotative position.

8. A step assembly as defined in claim 6 wherein said locking means is comprised of a stop plate secured to said first end of said step shaft and having a dimension preventing it from passing through said elongated aperture, and a geometric configuration which prevents rotation of said step shaft when said stop plate is located immediately adjacent said mounting brace bracket.

9. A step assembly comprising:

a mounting base bracket;

an apertured pivot block pivotally mounted on said mounting base bracket;

an elongated step shaft extending slidably through the aperture in the pivot block and including a first end disposed on one side of the pivot block, and a second end disposed on the opposite side of the pivot block, said shaft being rotatable in said pivot block about its longitudinal axis in all except one operative position of said elongated step shaft;

a step secured to the second end of said step shaft and extending outwardly therefrom in a direction substantially normal to the longitudinal axis thereof; and means for selectively locking said elongated step shaft against rotative movement around its axis when said step shaft is slid downwardly through the aperture in the pivot block to an operative location in which said step is at its lowermost location.

* * * * *